United States Patent [19]

Perraudin

[11] Patent Number: 4,755,760

[45] Date of Patent: Jul. 5, 1988

[54] DEVICE FOR COMBINING TWO ALTERNATING SIGNALS OF THE SAME FREQUENCY

[75] Inventor: Claude Perraudin, Meudon, France

[73] Assignee: C.G.R. MeV, Buc, France

[21] Appl. No.: 1,191

[22] Filed: Jan. 7, 1987

[30] Foreign Application Priority Data

Jan. 10, 1986 [FR] France ..... 86 00323

[51] Int. Cl.[4] ..... H01J 23/00

[52] U.S. Cl. ..... 328/233; 333/137

[58] Field of Search ..... 333/137, 117, 121, 122, 333/125; 328/233, 85, 103, 104, 105

[56] References Cited

U.S. PATENT DOCUMENTS

| | | | |
|---|---|---|---|
| 2,948,863 | 8/1960 | Honda | 333/113 |
| 3,036,278 | 5/1962 | Chait et al. | 328/34 |
| 3,058,071 | 10/1962 | Walsh et al. | 333/122 X |
| 3,495,191 | 2/1970 | Zilkoski | 333/159 |
| 3,517,317 | 6/1970 | Sire | 325/128 |
| 3,582,790 | 6/1971 | Curtis | 333/117 X |
| 3,761,665 | 9/1973 | Nagao et al. | 219/10.55 |
| 4,492,938 | 1/1985 | Young | 333/137 X |
| 4,575,697 | 3/1986 | Rao et al. | 333/159 X |
| 4,682,126 | 7/1987 | Milberger et al. | 333/81 B |

FOREIGN PATENT DOCUMENTS

| | | | |
|---|---|---|---|
| 0136105 | 8/1983 | Japan | 333/125 |
| 1151289 | 5/1969 | United Kingdom . | |

OTHER PUBLICATIONS

Internationale Elektronische Rundschau, vol. 25, No. 4, Apr. 1971, pp. 101–103, Berlin, DE; E. Pivit: "Ein hochleistungstungszirkulator fur das deutsche Elektronen-Synchrotron DESY".

L. Thourel: "Dispositifs A Ferrites Pour Micro-Ondes", 1969, pp. 140–153, Masson et Cie., Editeurs, Paris, FR; pp. 140 and 151–153, paragraphs 5.4.1 and 6.1.

*Primary Examiner*—Paul Gensler
*Assistant Examiner*—Seung Ham
*Attorney, Agent, or Firm*—Oblon, Fisher, Spivak, McClelland & Maier

[57] ABSTRACT

A device is provided for adding to signals of the same frequency but of any phases and amplitudes. The device has two inputs and two outputs. The outputs each deliver a combination of the signals fed to the input. In a particular application, corresponding to reinjection of a recovery signal from a linear accelerator, the combination is an addition. At a first output of the device the whole of the added signal is recovered for reinjection, at a second output of the device the signal is zero. The efficiency of the device is total.

5 Claims, 4 Drawing Sheets

FIG_2-a
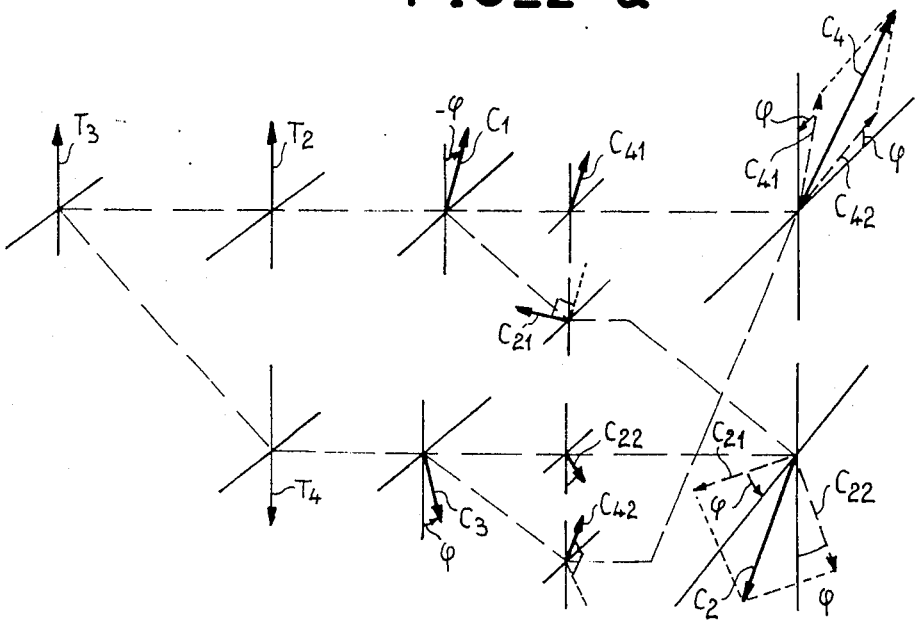
FIG_2-b
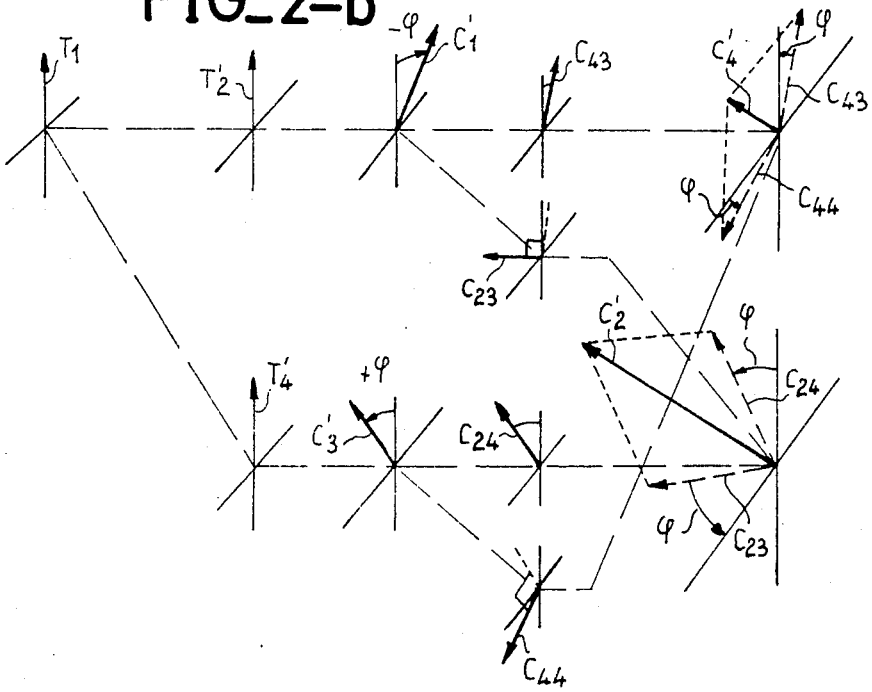

FIG_3-a
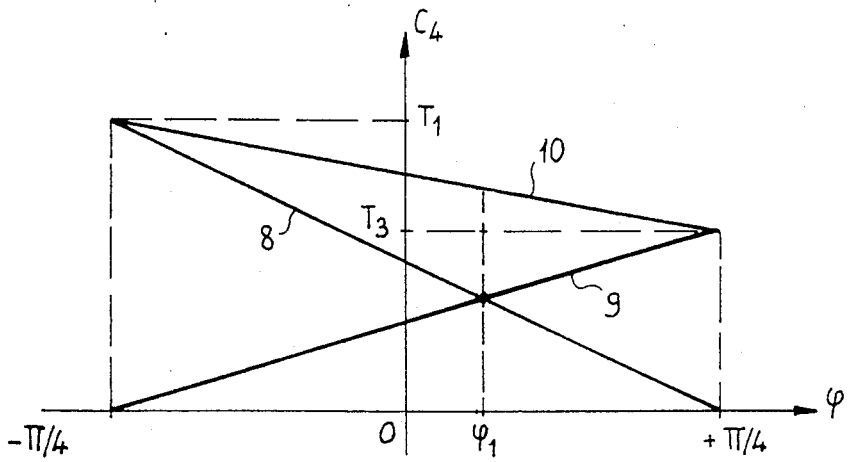
FIG_3-b
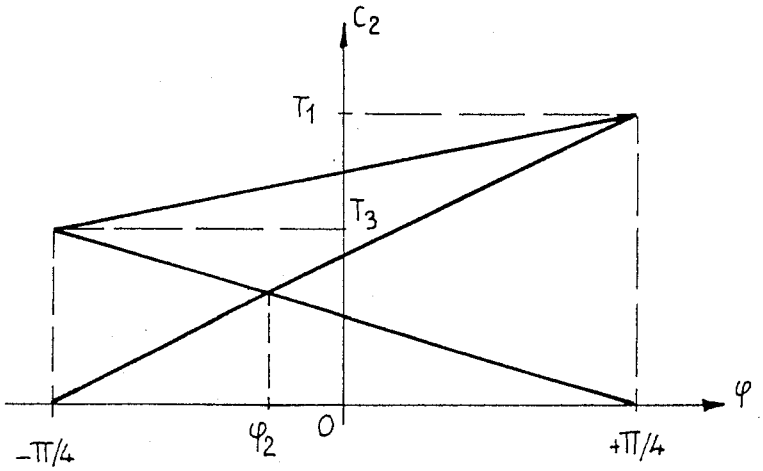

DEVICE FOR COMBINING TWO ALTERNATING SIGNALS OF THE SAME FREQUENCY

BACKGROUND OF THE INVENTION

1. Field of the Invention

The present invention relates to a device for combining two alternating signals of the same frequency. It relates more particularly to the addition of two signals whose phase and amplitude are different. In a particular application, the invention is used in the ultra high frequency field. In one example, resonating cavities of a linear accelerator are fed with an ultra high frequency signal. The electron beam, produced by the cathode of this accelerator, connects the ultra high frequency energy from the cavities, settles down and strikes an anode target with an energy which depends essentially on the energy of the ultra high frequency signal collected. The efficiency of such a collection is not complete. In the application mentioned, the ultra high frequency signal which is not absorbed by the electron beam may in this case be recovered then reinjected to be added to the supply signal. With the device of the invention, said addition is improved.

2. Description of the Prior Art

Different means are known for adding alternating signals of the same frequency. In particular, in ultra high frequency applications, the magic T and the directional coupler fulfill this role, to the extent that the signals to be added are presented correctly in phase and in amplitude. The phase constraints are such that the magic T adds signals presented in phase whereas the directional coupler, also called 3 dB coupler, adds signals presented in phase quadrature. In so far as the amplitudes are concerned, it is necessary, in one case as in the other, for them to be equal for the signals to be added. If such is not the case, it can be shown that with any of these systems, with the phase requirements satisfied, there is recovered in an outlet channel the sum of the signals admitted at the input reduced by the half difference of these signals. On the other output channel, it is this half difference which is recovered. It is evident that if this difference is zero, with the signals being equal, all the power is available at a single output and nothing is distributed to the other. Now, in the application mentioned, equality is never reached: the recovered signal is never more than a fraction of the supply signal. And to cause an accelerator to operate correctly for recovery, it is necessary to accurately add the supply signal and the recovered signal. The invention allows this result to be reached.

SUMMARY OF THE INVENTION

The invention provides then a device for combining two alternating signals of the same frequency, including successively:

a first adjustable phase shifter for phase shifting the first of these signals with respect to the second one, a first combination means having two inputs, receiving the first two signals and two outputs for delivering a third and a fourth signal, a second adjustable phase shift for phase shifting the third signal with respect to the fourth signal, and a second combination means with two inputs for receiving the third and fourth signals, and two outputs for delivering a fifth and a sixth signal, this fifth and this sixth signal being a combination of the first two signals in a mode which depends on the setting of the adjustable phase shifters.

BRIEF DESCRIPTION OF THE DRAWINGS

The invention will be better understood from reading the following description with reference to the accompanying Figures. They are given solely by way of indication and are in no wise limitative of the invention. In the Figures, the same references designate the same elements. They show:

FIGS. 2*a* and 2*b*: vectorial diagrams showing the combination of these signals between the first and second combination means;

FIGS. 3*a* and 3*b*: diagrams for setting the second phase shifter; and

DESCRIPTION OF THE PREFERRED EMBODIMENT OF THE INVENTION

Figure 1:
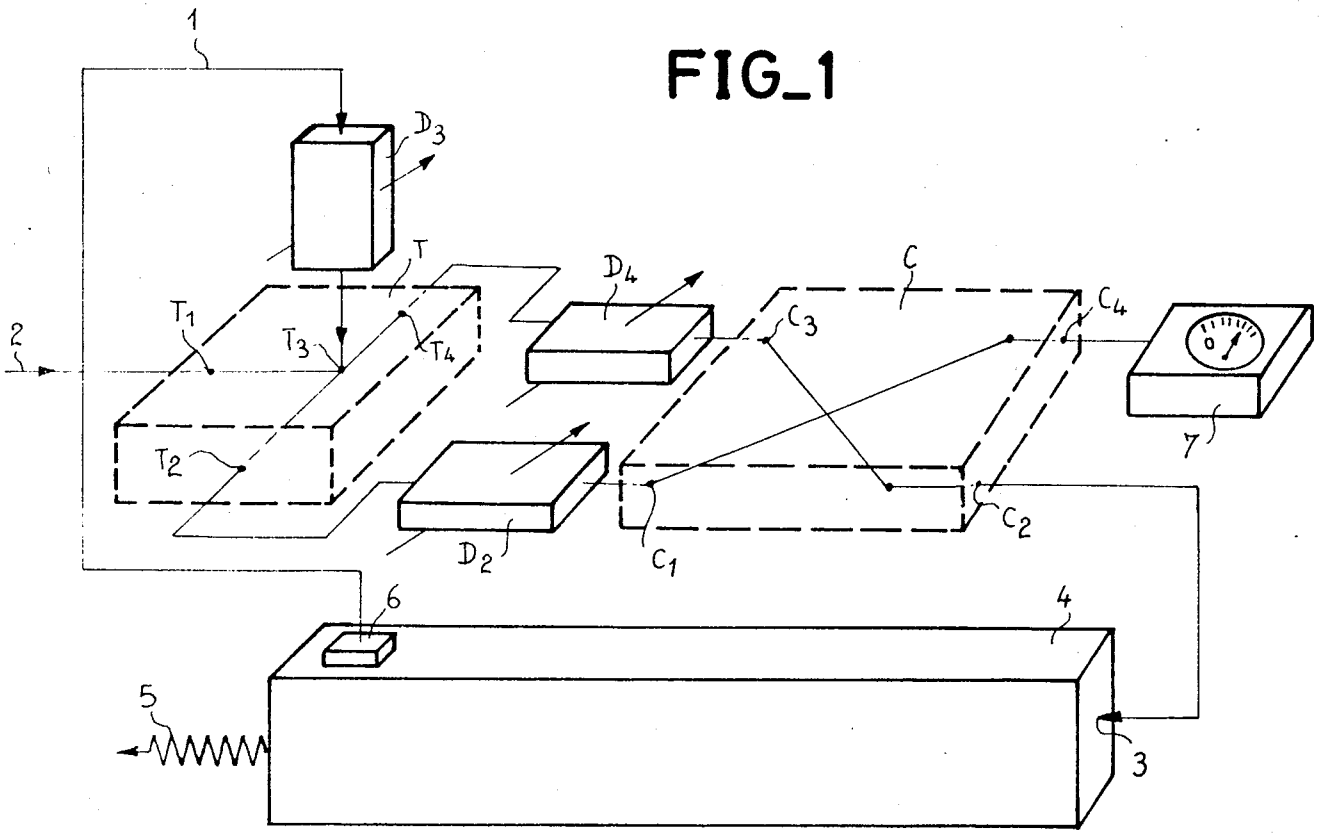
FIG. 1: a schnematical representation of the device of the invention in a particular application.

FIG. 1 shows in an ultra high frequency application a combining device in accordance with the invention. It includes a first phase shifter D3 for phase shifting a first signal available at a connection 1, with respect to a second signal available at a connection 2. These two signals, once the phase shift imposed, are fed to two inputs of a first combining means: here a magic T, also called hybrid T. These two signals are fed to the orthogonal input T1 and T3 of the T. They leave through the opposite outputs T2 and T4. The signals available at outputs T2 and T4 are fed to the inputs of a second phase shifter D2–D4 from which they leave for driving two inputs of a second combining means C. Means C is here a directional coupler. The third and fourth signals from the phase shifter D2–D4 are fed to the inputs C1 and C3 of coupler C. They are delivered combined at the outputs C2 and C4. In the particular application contemplated, the signal available at C2 is the sum of the signals available at connections 1 and 2, the signal available at C4 being zero. The signal from the output C2 may be fed to an ultra high frequency excitation input 3 of a linear accelerator 4. This linear accelerator emits, for example, a radiation X 5. This linear accelerator includes recovery means 6 for recovering the part of the ultra high frequency signal, fed at 3, and which is not absorbed for producing the radiation 5. The signal available at connection 1 is precisely the signal taken by the recovery means 6. When the device is correctly adjusted, an indicator 7 connected to output C4 shows that this output distributes no energy (0 indication) and consequently all the energy from connections 1 and 2 is applied to the input 3 of the accelerator 4.

The operation of the device of the invention will now be described with reference to FIGS. 2*a* and 2*b*. In these FIGS., for simplifying the explanation, the names of the signals have been identified by the names of the inputs and outputs of the combining means to which they refer. These FIGS. show pictorial diagrams in which, conventionally, the phase components due to the alternating movements of the signals have been eliminated. The references are then mobile references rotating at the frequency of the two signals.

Let us consider a signal T3 fed to the input T3 of the T. This signal appears, in a way known per se, at the phase opposition outputs T4 and T2. The signal T2 being in phase with the signal T3. For simplifying the explanation, the second phase shifter D2–D4 is a symmetric phase shifter. The phase shift applied to a wave on one side is applied in the reverse direction to the other wave on the other side. Thus, the signal T2 is phase shifted by $-\varphi$ to become C1. Similarly, T4 is phase shifted by $+\varphi$ to give C3.

Let us now consider the contribution of a signal C1 admitted at the input C1 of coupler C to the signals available at the output C4 and C2. These contributions C41 and C21 are respectively in phase and in phase quadrature with C1. The components at output C2 and C4 due to the signal introduced at the input C3 are C22 and C42, respectively in phase and in phase quadrature with C3. In short, from the signal T3 fed to the input T3 their results the signal C4, formed of C41 and C42, and a signal C2 formed of C21 and C22. A rapid verification shows that C4 and C2 are mutually in phase opposition, that their phase with respect to T3, which is equal to $-\pi/4$, $3\pi/4$, is independent of $\varphi$ and that, on the other hand, the amplitudes of these signals are dependent on $\varphi$.

FIG. 2*b* shows a progress of the same kind for the components of a signal T1 fed to the input T1 of the T. The opposite outputs T2 and T4 now deliver the signals T'2 and T'4 in phase with T1. Once through the second phase shifter D2–D4, these signals become C'1 C'3 phase shifted respectively by − and $+\varphi$. The signal C'1 contributes to a signal C'4 in the form of a component C43 in phase with C'1 and to a signal C'2 in the form of a component C23 in phase quadrature with C'1. Similarly, C'3 contributes to the signals C'4 and C'2 by two components, respectively C44 and C24, in phase quadrature and in phase with C'3. The geometric composition of these components shows us that the components C'4 and C'2 are in phase with each other, phase shifted independently of $\varphi$ with respect to T1 ($\pi/4$), and have amplitudes which depend on $\varphi$.

If we feed signals T1 and T3 simultaneously to the inputs T1 and T3 of the T, we may state that the distribution of the powers at outputs C2 and C4 depend on $\varphi$. In particular, in one example, if $\varphi=\pi/4$, it may be verified that all the power leaves at C2 or at C4 depending on whether the input is at T1 or T3. This situation is shown in FIGS. 3*a* and 3*b*. In FIG. 3*a*, when $\varphi=-\pi/4$, and when only T1 is fed to the input T1, the signal C4 is equal to T1. Still without feeding anything to T3, but by causing $\varphi$ to vary (curve 8), C4 can be caused to decrease to 0 when $\varphi=+\pi/4$. The signal available at C4 varies similarly when the signal T3 is alone fed to the input T3 of the T (curve 9). If T1 and T3 are applied simultaneously, the output C4 evolves as shown by the curve 10 when $\varphi$ varies. It is interesting to notice that, whatever the difference of level between T1 and T3, there exists a phase shift $\varphi 1$ between $-\pi/4$ and $+\pi/4$ for which the contributions of these signals in the signal C4 are equal. FIG. 3*b* shows correspondingly what happens under the same conditions for C2. For $\varphi=\varphi 2$, the component of C2 due to C1 is equal to that due to T3.

In the invention, in the particular application considered, $\phi$ is adjusted so that at the unused output C4 of the combining device, the components due to T1 and T3 are of the same amplitude. This means, in FIGS. 2*a* and 2*b*, that C4 and C'4 are equal values. But these components are in phase quadrature. It will then be noted that if T1 is phase shifted by $\pi/2$ with respect to T3 by means of the phase shifter D3, the components C'4 will be in phase opposition with the component C4. Since they are of the same amplitude, they neutralize each other mutually. The result is that no energy is available at output C4 of the combining device: all the energy is to be found then at C2. This is the addition it was desired to obtain.

The setting of the phase shifter D2–D4 (to the value $\varphi 1$ in the example given) and the setting of phase shifter D3 are made while observing the indications of the indicator 7 connected to outputs C4. The principle of these settings is simple: it consists in setting the phase shifter successively, and possibly iteratively, so as to reduce the power available at output C4. The combination of the signals at connections 1 and 2 is here defined by the accuracy of this setting. Any other method of combination may be used. The setting procedures must be adapted consequently, it should be noted that the combination phenomenon is a linear phenomenon. Therefore, in the application envisaged, the setting of the phase shifters is first of all undertaken at low power on connection 2.

The duality of use of the magic T and of the directional coupler is evident. In fact, each of them is used with specific phase requirements: signals fed in phase in one case and in phase opposition in the other. Now, the presence of phase shifter D3 and of phase shifter D2–D4 allows the phase of the signals introduced to be modified. Consequently, it can be shown that the invention operates also when the first combining means is the directional coupler and when the second is the magic T. In all cases, the signal combinations may be obtained. For each of these solutions, vectorial diagrams should be plotted corresponding to FIGS. 2*a* and 2*b* so as to derive therefrom equivalent remarks concerning the phases and the amplitudes of the signals available at the outputs of the second combining means as a function of the phases and amplitudes of the signals fed to the inputs of the first combining means.

Figure 4:
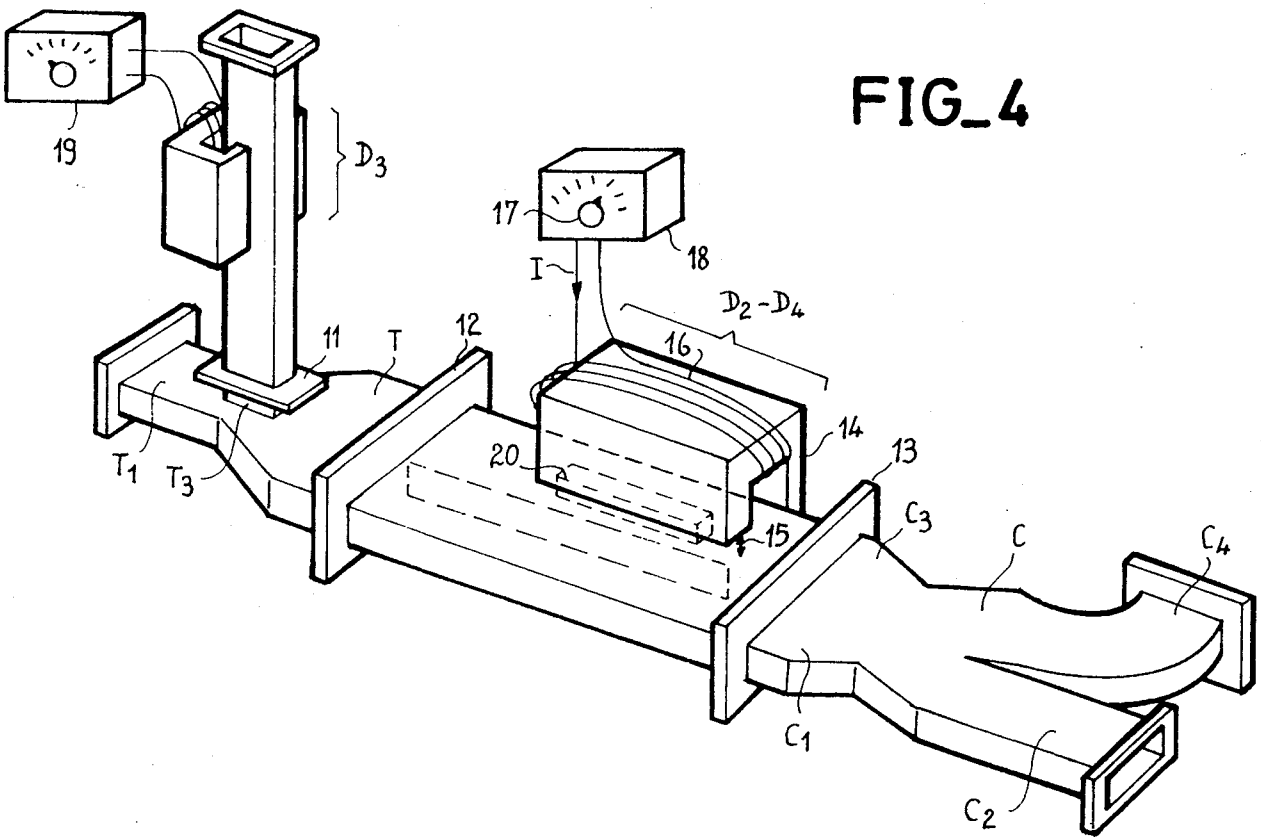
FIG. 4: the representation of a particular embodiment of the device of the invention.

FIG. 4 shows one example of an industrial application of a device of the invention. There are shown in particular a first phase shifter D3, a magic T, a second phase shifter D2–D4 and a directional coupler C. These different elements are connected together with fixing lugs such as 11 to 13. In this embodiment, the phase shifter D2–D4 is not a symmetric phase shifter. The symmetric phase shifter which has been chosen above was justifed to the extent that it allowed a simple symmetrical explanation of the vectorial compositions envisaged to be given. For example, if in the preceding application the setting corresponding to the addition were obtained by $\varphi 1$ of symmetrical phase shifter and by $\Phi$ for the first phase shifter, with a non symmetrical second phase shifter D2–D4, such as shown, these settings become respectively $2.\varphi$ 1 and $\pi+\varphi 1$.

Different types of phase shifters may be contemplated, for example quartz phase shifters. In this case, the progressive introduction of a dielectric into the wave guide causes the phase shift. Preferably, so called ferrite phase shifters are chosen. In this type of phase shifter, a magnetic circuit 14 has an elongate air gap 15 along a wave guide which conveys an ultra high frequency signal to be phase shifted. A ferrite 20 is placed in the wave guide, in the air gap of the magnetic circuit. By causing a given current I to flow through an excitation coil 16 of the magnetic circuit, the magnetic field in the air gap can be modified. The result is a local modification of the propagation conditions and so a phase shift of the wave which follows this path. By adjusting at 17 the current I of a circuit 18 feeding coil 16 the phase shift applied by the phase shifter thus formed may be modified. The phase shifter D3 also includes a circuit 19 for adjustably supplying the current which energizes the electromagnet.

Finally, the above described device may allow a multiplicative effect to be obtained, in particular in a wave guide for testing elements therein under a high power when only a low power generator is available. It is sufficient to feed to the test wave guide with a power P0 through the combining device of the invention. A power P1 is accordingly applied to the inlet of the test wave guide. At the outlet of the test wave guide a fraction $\alpha$. P1 is taken of the power P1 fed to the input of the guide. This power taken off is applied to the second combining input of the device of the invention. This device is set for addition as for the application to nuclear accelerators. It can be readily shown that the useful power for the test is then $P1=P0/(1-\alpha)$. By adjusting $\alpha(<1)$ P0 can be multiplied by the desired amount.

What is claimed is:

1. A linear accelerator combining apparatus for injecting into the input of said accelerator an electromotive signal corresponding to the sum of a supply signal and a recovery signal from said accelerator, comprising:

a first adjustable phase shifter for continuously phase shifting said recovery signal with respect to said supply signal;

a first combining means having two inputs for receiving said phase shifted recovery signal and said supply signal and two outputs for delivering a first and a second output signal;

a second adjustable phase shifter means for phase shifting said first output signal with respect to said second output signal; and a second combining means with two inputs for receiving said first and second output signals and two outputs for delivering a third and a fourth output signal wherein said third and said fourth output signals are combinations of said supply signal and said phase shifted recovery signal in a mode which depends on the settings of said two adjustable phase shifters wherein the initial settings of said phase shifters occurs at a supply signal of essentially zero and wherein said fourth signal is fed to an ultra-high frequency excitation input of said accelerator and wherein the output of said accelerator includes a radiation signal and said recovery signal wherein said recovery signal includes a portion of said ultra-high frequency excitation input signal which is not absorbed for producing said radiation signal.

2. The device as claimed in claim 1, wherein the combination is a power addition, the first combining means being a magic T and the second combining means being a directional coupler, one of the output signals of said coupler representing the sum of the power input and recovery signals, the other output signal of the coupler being zero.

3. The device as claimed in claim 1 or claim 2, wherein said phase shifters are ferrite phase shifters.

4. The device as claimed in claim 1 or claim 2, wherein said phase shifters are quartz phase shifters.

5. The device as claimed in any one of claims 1 to 2, wherein said second phase shifter is a symmetrical phase shifter for symmetrically phase shifting said first and second output signals.

* * * * *